US008453956B2

(12) United States Patent
Coray

(10) Patent No.: US 8,453,956 B2
(45) Date of Patent: Jun. 4, 2013

(54) SLURRY RETURN SYSTEM FOR GRINDING MILLS

(76) Inventor: Dale Coray, Bali (ID)

( * ) Notice: Subject to any disclaimer, the term of this patent is extended or adjusted under 35 U.S.C. 154(b) by 461 days.

(21) Appl. No.: 12/594,841

(22) PCT Filed: Apr. 10, 2008

(86) PCT No.: PCT/AU2008/000504

§ 371 (c)(1),
(2), (4) Date: Nov. 5, 2009

(87) PCT Pub. No.: WO2008/124867

PCT Pub. Date: Oct. 23, 2008

(65) Prior Publication Data

US 2010/0206972 A1 Aug. 19, 2010

(30) Foreign Application Priority Data

Apr. 12, 2007 (AU) ..... 2007901922

(51) Int. Cl.
*B02C 17/22* (2006.01)

(52) U.S. Cl.
USPC ..... 241/182; 241/299

(58) Field of Classification Search
USPC ..... 241/182, 183, 299, 101.2
See application file for complete search history.

(56) References Cited

U.S. PATENT DOCUMENTS

| | | | | |
|---|---|---|---|---|
| 3,746,268 | A * | 7/1973 | Kastrinos | 241/179 |
| 4,966,471 | A * | 10/1990 | Trozzi | 384/151 |
| 5,000,462 | A | 3/1991 | Trozzi | |
| 5,464,163 | A | 11/1995 | Zoz | |
| 6,119,969 | A | 9/2000 | Racine | |

FOREIGN PATENT DOCUMENTS

CN 1586725 A 3/2005

* cited by examiner

*Primary Examiner* — Mark Rosenbaum
(74) *Attorney, Agent, or Firm* — Winthrop & Weinstine, P.A.

(57) ABSTRACT

A sand wheel seal for a grinding mill, which in use is internally disposed within said mill. Preferably the sand wheel seal is integrally formed with a mill throat liner wheel and may be releasably secured to a feed end of said mill. The grinding mill may be any one of a Sag, Ag, Ball or Rod mill.

4 Claims, 6 Drawing Sheets

SLURRY RETURN SYSTEM FOR GRINDING MILLS

TECHNICAL FIELD

The invention relates to a sand wheel seal (or slurry return system) for a grinding mill.

BACKGROUND

Prior art design of grinding mill sand wheel seals, which include Sag, Ag, Ball and Rod mills, see the "sand wheel" as a fabricated bucket design which is mounted or combined with the feed trunion insert. This design only allows the seal to be externally mounted or outside of the actual feed end of the mill.

This design has many issues that are not optimum. First the slurry is allowed to exit the mill before it can be collected then dumped back into the mill. This allows for spillage, which in turn enters the actual trunnion of the mill, creating several problems. The first and most severe problem is the contamination of lubrication systems, however other problems also occur, such as damaged trunnion seals and considerable mess in the surrounding area.

As such, sand wheel seals are mounted externally. They considerably reduce the trunnion internal diameter, thus dictating the size of internal wear parts, and the casting that can be used in the mills. Furthermore this externally restricts the size and/or safe working load of the lining machine which is used to maintain the internals of the mill. In certain instances when a mill is overloaded, large material becomes jammed in the sand wheel between the feed chutes thus destroying the components, which results in necessary repairs or replacement. A further disadvantage of the prior art sand wheel seals, is that they cannot be replaced during a mill reline, and therefore additional downtime is required for their replacement.

It is an object of the present invention to provide a sand wheel seal for a grinding mill that will overcome or substantially ameliorate one or more of the deficiencies of the prior art, or provide a useful alternative.

SUMMARY OF INVENTION

According to a first aspect the present invention consists in a sand wheel seal for a grinding mill, which in use is internally disposed within said mill.

Preferably said sand wheel seal is integrally formed with a mill throat liner.

Preferably said sand wheel seal may be releasably secured to a feed end of said mill.

Preferably said grinding mill is anyone of a Sag, Ag, Ball or Rod mill.

According to a second aspect the present invention consists in a sand wheel seal for a grinding mill, said sand wheel seal integrally formed with a mill throat liner, and when in use is internally disposed within said mill and releasably secured to a feed end of said mill.

Preferably said sand wheel seal may be anyone of cast, fabricated steel, moulded rubber or moulded polyurethane.

According to a third aspect the present invention consists in a slurry return system for a grinding mill, said system comprising a feed chute disposed externally of said grinding mill, wherein said sand wheel seal is internally disposed within said mill.

Preferably said sand wheel seal is integrally formed with a mill throat liner.

Preferably in use, said sand wheel seal is not operably connected to said feed chute.

According to a fourth aspect the present invention consists in a feed chute for a grinding mill having an internally disposed sand wheel seal, said chute operably supporting a feed pipe externally of said mill.

Preferably in use, the feed chute is not operably connected to said sand wheel seal.

Preferably said sand wheel seal is integrally formed with a mill liner.

According to a fifth aspect the present invention consists in a slurry return system for a grinding mill, said system comprising a sealing arrangement that is integrally formed with at least one liner segment disposed internally within said mill, and a feed pipe disposed externally of said grinding mill and supported by a feed chute that may be removably located at or near said mill.

According to a sixth aspect the present invention consists in a throat liner segment for a grinding mill, wherein said liner has a portion of sand wheel seal integrally formed therein, and in use when said throat liner segment is attached to said mill, said portion of the sand wheel seal is internally disposed within said mill.

BRIEF DESCRIPTION OF THE DRAWINGS

Preferred embodiments of the invention will now be described, by way of example only, with reference to the accompanying drawings in which.

DESCRIPTION OF THE PREFERRED EMBODIMENT

Figure 1:
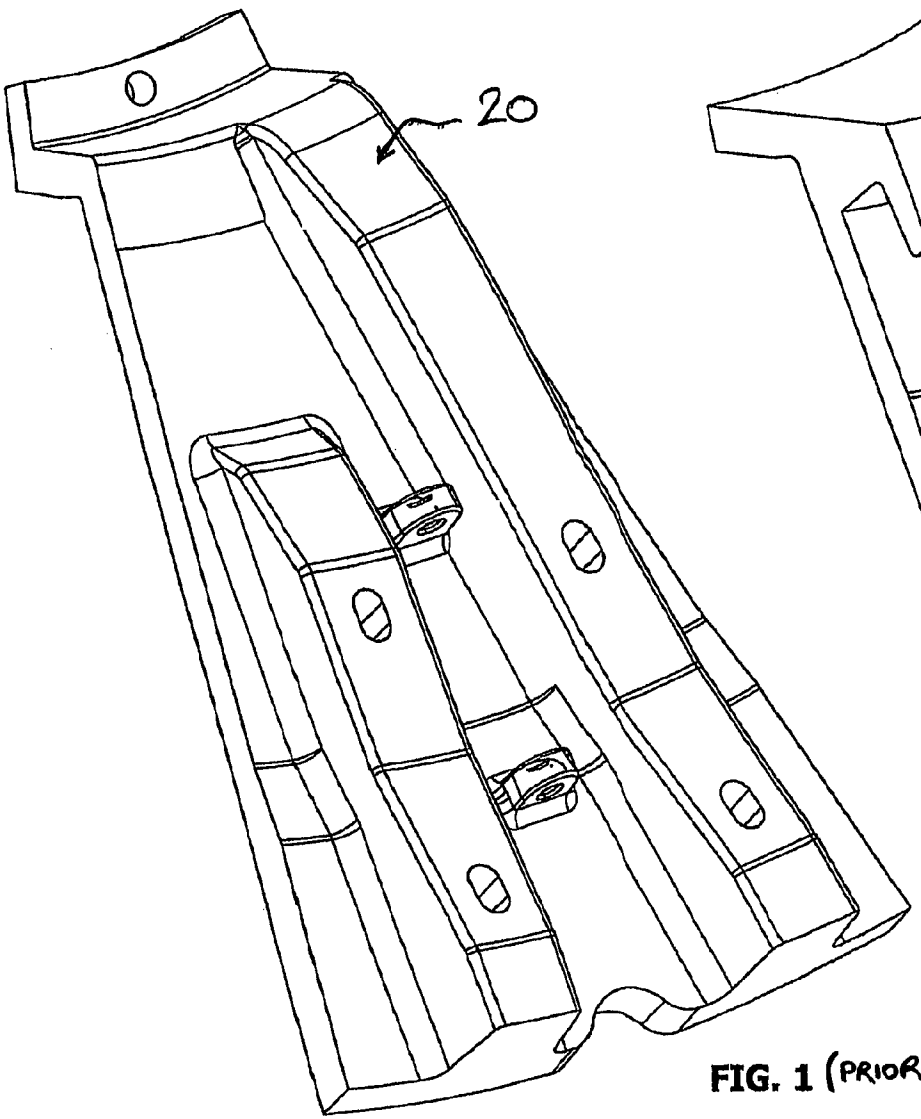
FIG. 1 (PRIOR ART)
FIG. 1 is a perspective view of a prior art liner for a SAG mill.
Figure 1A:
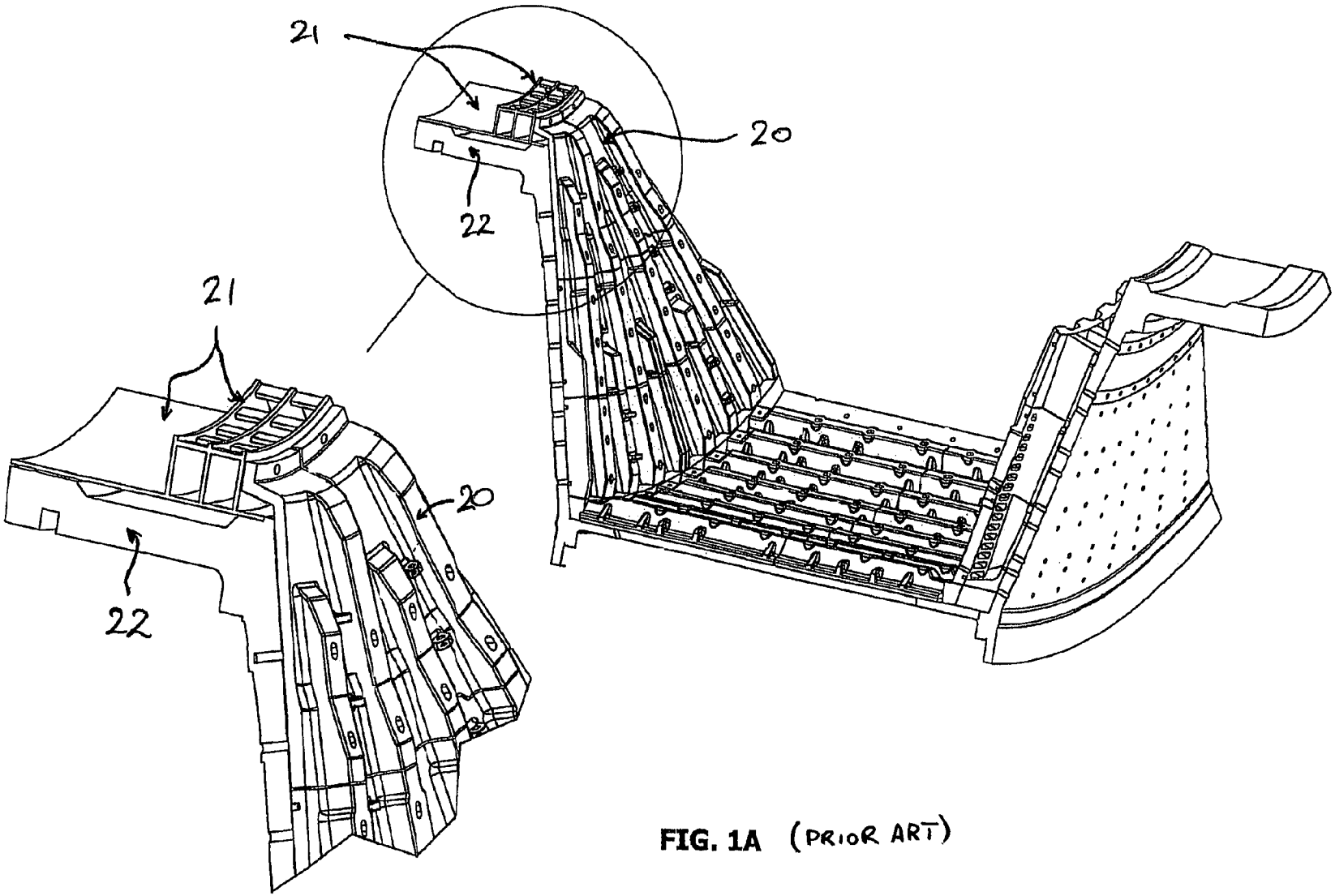
FIG. 1A (PRIOR ART)
FIG. 1A is a perspective view and enlarged detail of the assembly of the prior art liner of FIG. 1, with an externally mounted prior art sand wheel.

FIGS. 1 and 1A depict perspective views of a prior art liner 20 that can be attached to a prior art sand wheel 21. In order for the sand wheel to be used, it must be externally mounted to a SAG mill, and is connected the feed trunnion liner assembly 22.

Figure 2:
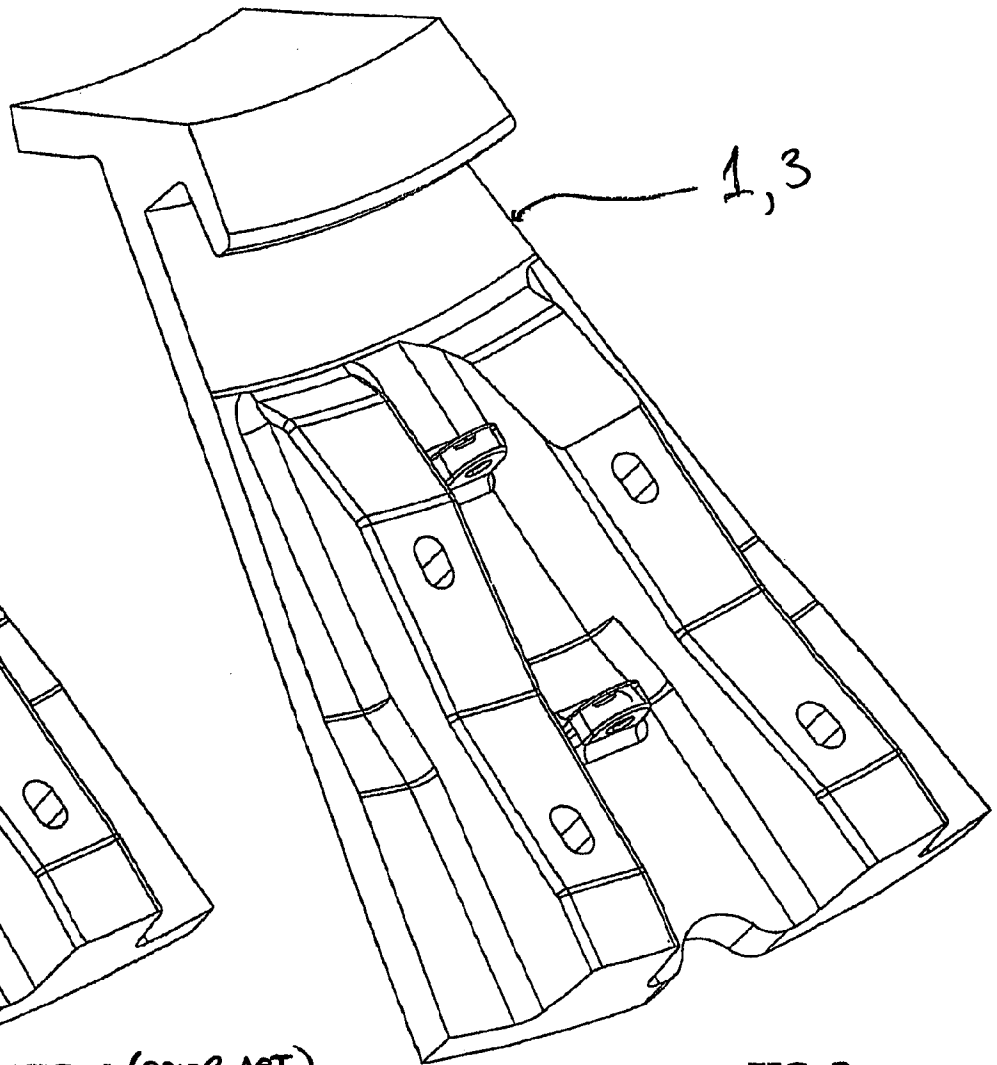
FIG. 2 is a perspective view of the end detail of sand wheel seal segment in a first preferred embodiment.
Figure 2A:
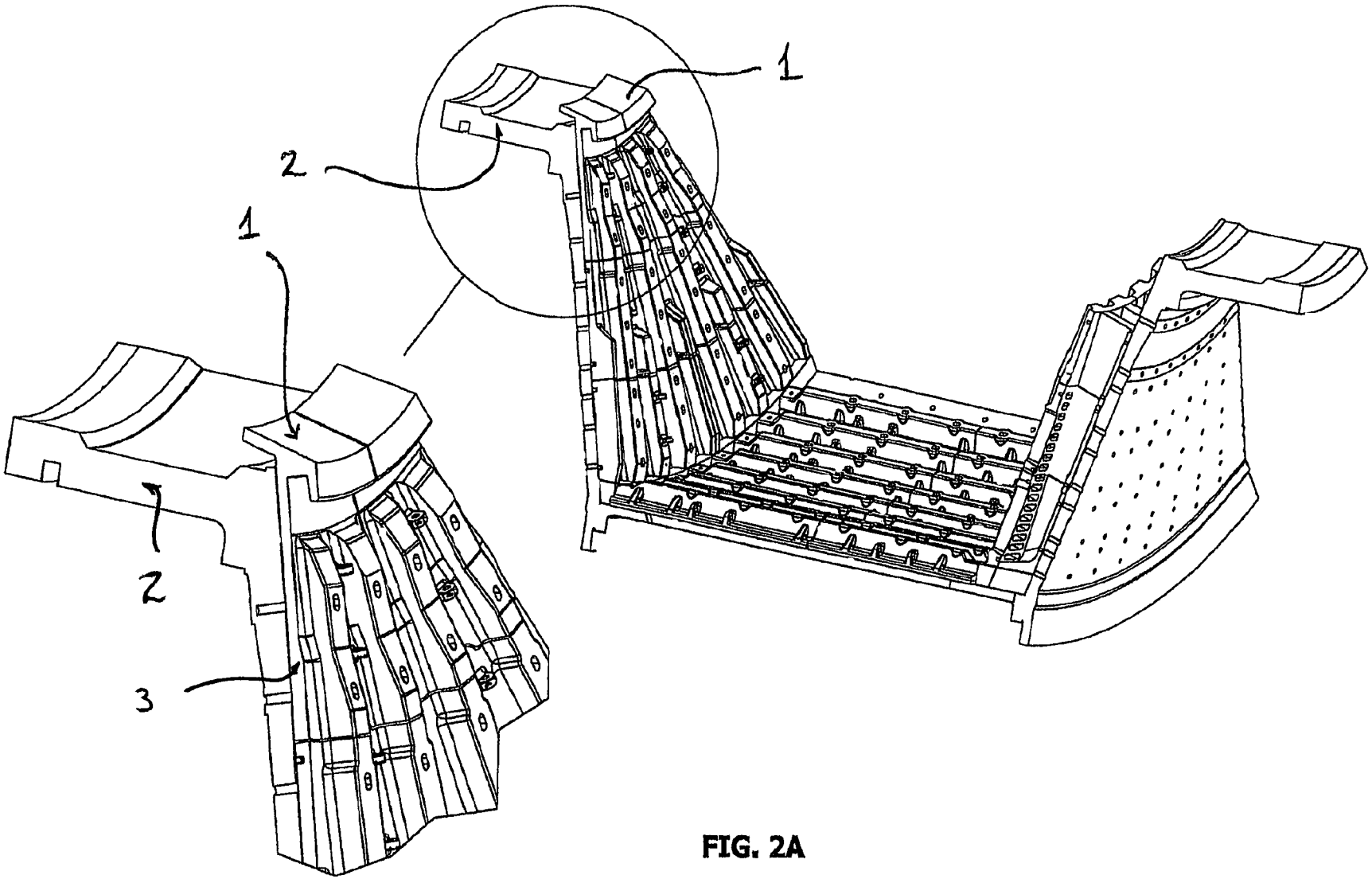
FIG. 2A is a perspective view and enlarged detail of the sand wheel seal segment of FIG. 2 attached to the trunnion end of a SAG mill.

Referring to FIGS. 2 and 2A, there is shown a perspective view of a segment of a sand wheel seal 1 in accordance with the present invention. The segment of a sand wheel seal 1 is integrally formed with a mill throat liner 3 and in use is internally mounted on trunnion liner assembly 2 within a SAG mill.

An advantage of this segment that forms part of the internally mounted sand wheel seal, is that compared to prior art externally mounted sand wheel seals, less components are required and maintenance down time is reduced, because segment 1 can be replaced during a scheduled mill reline. It also allows for larger feed chutes to be used with the SAG mills, which reduces wear in the chute and further reduces plugging of the feed chute that requires unnecessary mill downtime.

Also, the use of such a sand wheel seal made up of segments 1, eliminates the jamming problems experienced with the externally mounted prior art wheels when the mill is overloaded.

The segment sand wheel 1, may be cast, fabricated steel or of moulded rubber/polyurethanes. Whilst the abovementioned embodiment is described with reference to use with a SAG mill, the embodiment may also be used on an Ag, Ball or Rod mill.

Using the sand wheel seal 1 of the abovementioned embodiment of FIGS. 2 and 2*a*, not only has the advantage of allowing use of a larger feed chute, it also allows for a modified feed chute design that has further advantages. This is best understood by first referring to a prior art feed chute.

Figure 5:
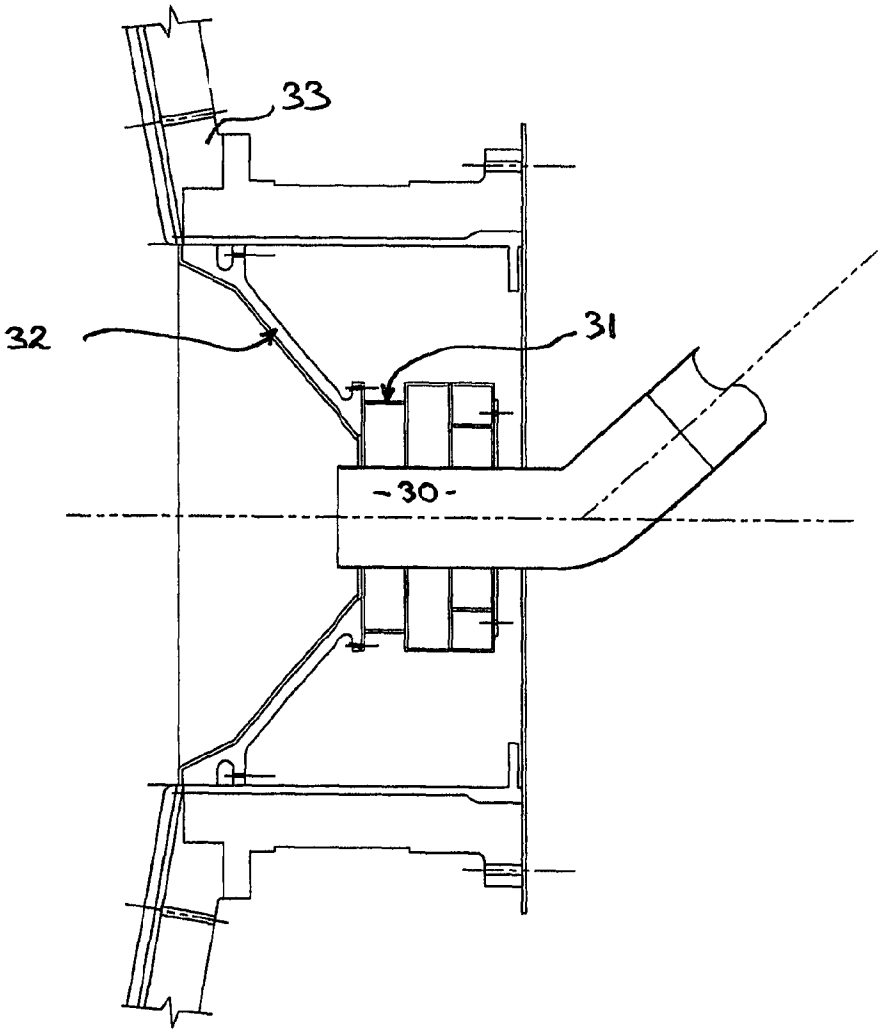
FIG. 5 (PRIOR ART)
FIG. 5. is a schematic side view of a prior art slurry return system where the feed trunnion insert is attached to a prior art seal.

FIG. 5 depicts a prior art slurry return system where the feed trunnion insert 32 incorporates a prior art seal 31. In this prior art arrangement the feed trunnion insert 32 is attached to mill 33. As such, when the feed chute/pipe 30 is removed, the feed trunnion insert 32 and seal 31 remain fastened to the mill 33. In order to perform maintenance inside the mill 33, the trunnion insert 32 and seal 31 must be removed. In a normal mill this requires 12 hours additional downtime to remove and re-install.

Figure 3:
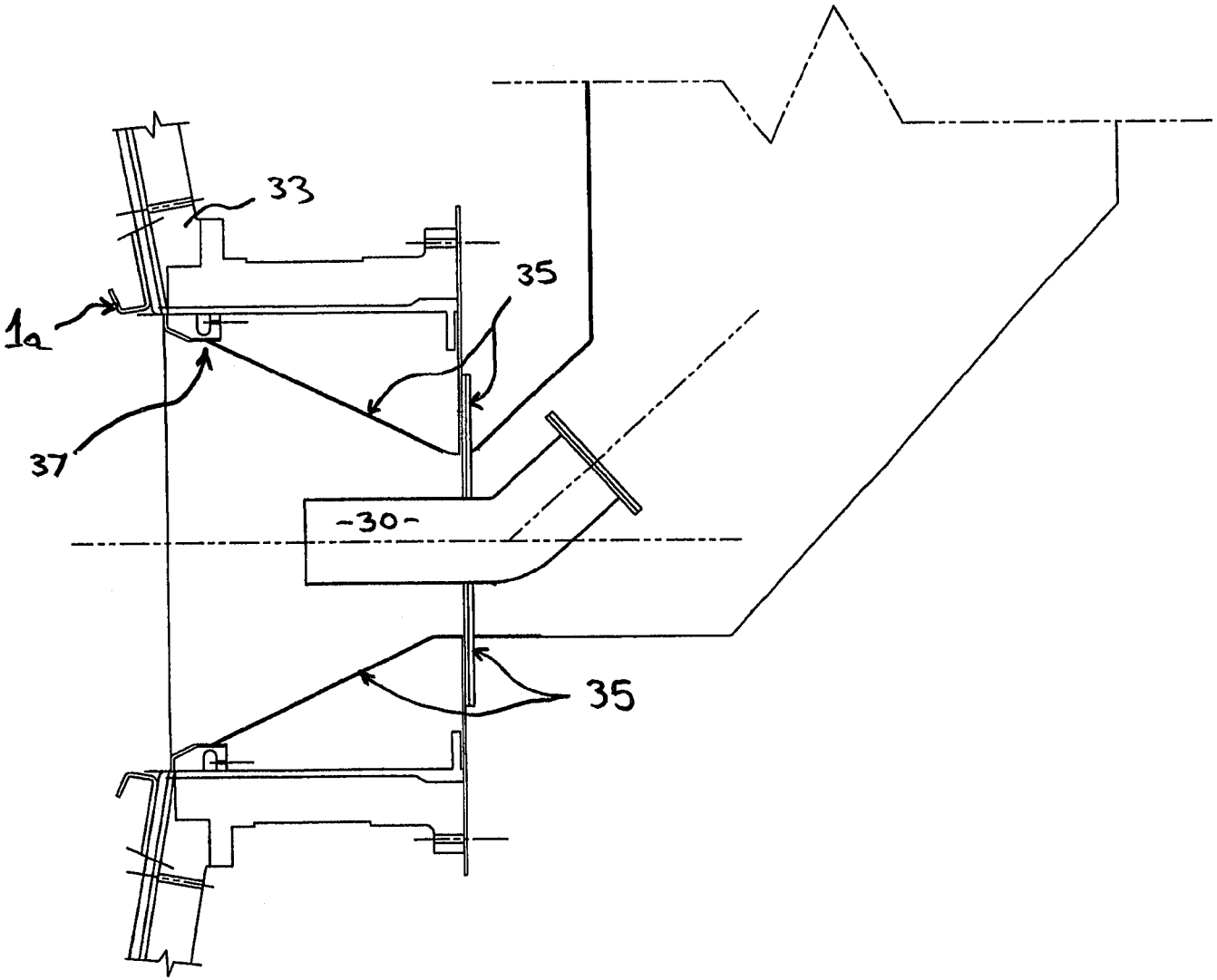
FIG. 3. is a schematic side view of a slurry return system in a second preferred embodiment.
Figure 4:
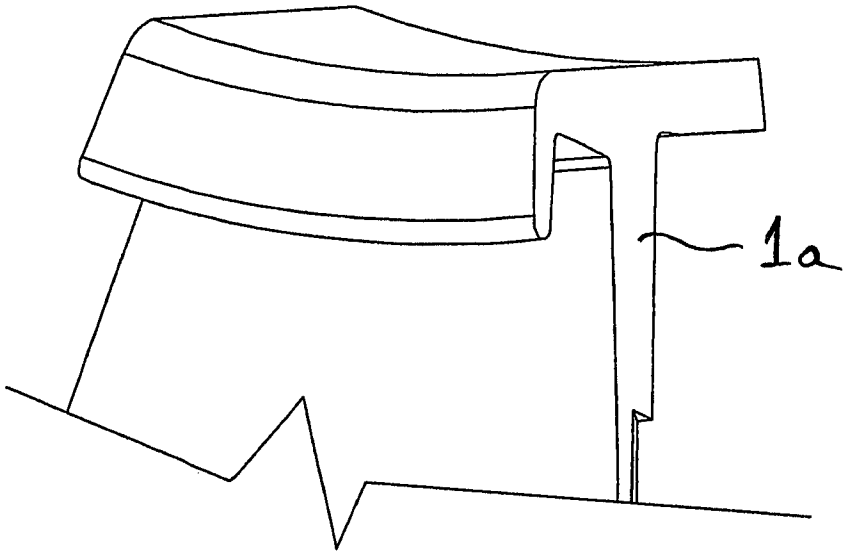
FIG. 4. is a partial perspective view of a liner and integrally formed "seal" segment used in the second preferred embodiment of FIG. 3.

However, in a second preferred embodiment a slurry return system having a segment sand wheel seal 1*a*, see FIGS. 3 and 4, similar to the sand wheel seal 1 (shown in FIGS. 2 and 2*a*) is utilised. In FIG. 3, the slurry return system has a feed pipe 30 that is attached to feed chute 35. An advantage of this arrangement is that as the "seal" 1*a* is formed integrally with the liner, and is internally disposed within the mill 33, the feed chute 35 that supports feed pipe 30, may be readily brought up to the mill 33 and abutted there against at a location 37. It may be held in place by a location pin only (not shown). As such, when mill 33 requires maintenance, feed chute 35 may readily be removed in a quick fashion. In such an arrangement, the feed chute 35 and pipe 30 may be removed in say, 15-20 minutes. This is because the externally mounted feed feed chute 35 is not operably connected to the seal arrangement of liner 1*a*. As earlier mentioned in the first embodiment, the use of an internally disposed liner 1*a* means that feed chute 35 may be larger than a prior art conventional feed chute. This slurry return system will allow the feed trunnion inserts on mills (in some cases) to be eliminated with simple modifications to the feed chutes. The actual mill bearing trunnion may then be coated with a protective coating.

The main features of the slurry return system of the present invention is as follows:

- The sand wheel seal is integral with the liner (1 and 1*a*), and is disposed internally of the mill, and may be releasably secured to a feed end of the mill.
- The sand wheel seal is typically replaced at a scheduled mill reline.
- As the sand wheel seal is internally disposed within the mill, it is not operably connected to the feed trunnion insert, thereby reducing downtime to remove the feed chute and feed trunnion insert.
- It may eliminate the need for a feed trunnion insert on some mills.

The terms "comprising" and "including" (and their grammatical variations) as used herein are used in inclusive sense and not in the exclusive sense of "consisting only of".

The invention claimed is:

1. A slurry return system for a grinding mill, said system comprising a feed chute disposed externally of said grinding mill, wherein a sand wheel seal is internally disposed within said mill, and said sand wheel seal is integrally formed with a mill throat liner.

2. A slurry return system as claimed in claim 1, wherein in use said sand wheel seal is not operably connected to said feed chute.

3. A slurry return system for a grinding mill, said system comprising a sealing arrangement that is integrally formed with at least one liner segment disposed internally within said mill, and a feed pipe disposed externally of said grinding mill and supported by a feed chute that may be removably located at or near said mill.

4. A throat liner segment for a grinding mill, wherein said throat liner segment comprises a portion comprising a sand wheel seal integrally formed therein, and in use when said throat liner segment is attached to said mill, said sand wheel seal is internally disposed within said mill.

* * * * *